US007918635B2

(12) United States Patent
Richter

(10) Patent No.: US 7,918,635 B2
(45) Date of Patent: Apr. 5, 2011

(54) BOOKBINDING MACHINE

(75) Inventor: Lutz Richter, Schkeuditz (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 14 days.

(21) Appl. No.: 12/359,352

(22) Filed: Jan. 26, 2009

(65) Prior Publication Data

US 2009/0175704 A1 Jul. 9, 2009

Related U.S. Application Data

(63) Continuation of application No. PCT/EP2007/006587, filed on Jul. 25, 2007.

(30) Foreign Application Priority Data

Jul. 26, 2006 (DE) ..... 10 2006 034 509
Jul. 26, 2006 (DE) ..... 10 2006 034 511
Jul. 11, 2007 (DE) ..... 10 2007 032 604

(51) Int. Cl.
*B42C 13/00* (2006.01)

(52) U.S. Cl. ..... 412/11; 412/13; 412/14

(58) Field of Classification Search ..... 412/1, 4, 412/6, 8, 11, 12, 13, 14, 18, 19, 22, 23, 24, 412/33, 37; 270/52.18, 58.07; 198/348, 198/357, 358, 687.1, 867.13–867.15
See application file for complete search history.

(56) References Cited

U.S. PATENT DOCUMENTS

| | | | | |
|---|---|---|---|---|
| 3,977,461 | A * | 8/1976 | Pol et al. | 164/155.5 |
| 4,981,291 | A * | 1/1991 | Honegger et al. | 270/52.3 |
| 6,092,801 | A | 7/2000 | Abbadessa et al. | |
| 6,299,810 | B1 * | 10/2001 | Blackinton, Jr. | 264/102 |
| 6,930,296 | B2 * | 8/2005 | Chen | 219/700 |
| 7,621,708 | B2 * | 11/2009 | Hampel et al. | 412/11 |
| 2002/0128990 | A1 * | 9/2002 | Kaminskas et al. | 706/45 |
| 2003/0215309 | A1 * | 11/2003 | Engert et al. | 412/33 |
| 2010/0239392 | A1 * | 9/2010 | Adler et al. | 412/6 |

FOREIGN PATENT DOCUMENTS

| | | | |
|---|---|---|---|
| DE | 19722376 | A1 | 12/1997 |
| DE | 202005007012 | U1 | 8/2005 |
| EP | 1529639 | A1 | 5/2005 |
| WO | 2005123390 | A1 | 12/2005 |

OTHER PUBLICATIONS

International Search Report dated Aug. 4, 2008.

* cited by examiner

*Primary Examiner* — Dana Ross
*Assistant Examiner* — Pradeep C Battula
(74) *Attorney, Agent, or Firm* — Laurence A. Greenberg; Werner H. Stemer; Ralph E. Locher

(57) ABSTRACT

A book binding machine for producing printed products, such as books, magazines or brochures, includes individually driven processing stations, such as a book spine processing station, a glue application station, a cover feeder and a pressing station, which are connected by a transport system that has a multiplicity of clamps for clamping-in book blocks. The clamps are driven individually, in particular by linear motors or servomotors, and are guided on a guide track.

13 Claims, 3 Drawing Sheets

BOOKBINDING MACHINE

CROSS-REFERENCE TO RELATED APPLICATIONS

This is a continuing application, under 35 U.S.C. §120, of copending International Application No. PCT/EP2007/006587, filed Jul. 25, 2007, which designated the United States; this application also claims the priority, under 35 U.S.C. §119, of German Patent Applications DE 10 2006 034 509.6, filed Jul. 26, 2006, DE 10 2006 034 511.8, filed Jul. 26, 2006, and DE 10 2007 032 604.3, filed Jul. 11, 2007; the prior applications are herewith incorporated by reference in their entirety.

BACKGROUND OF THE INVENTION

Field of the Invention

The invention relates to a book binding machine for producing printed products, such as books, magazines or brochures. The book binding machine includes individually driven processing stations such as a book block insertion station, a book spine processing station, a glue application station, a cover feeder and a pressing station. A transport system interconnects the processing stations and has a multiplicity of clamps for clamping-in book blocks.

Such book binding machines, for example adhesive or perfect binders, serve to produce adhesively bound brochures or book blocks for hardcovers, in which folded sheets and/or individual sheets which are collated to form a book block are connected by application of an adhesive to previously processed block spines. Possible binding methods and product variants are dependent on machine equipment. The latter includes substantially the functional units of a book block transport system, book block insertion station, spine processing, spine gluing, intermediate drying, side gluing, spine reinforcement, cover placing, cover pressing and drying.

German Utility Model DE 20 2005 007 012 U1 discloses such a book binding machine having a book block transport system. The book block transport system includes conveying devices which run around deflecting wheels and a multiplicity of clamps which are fastened at a uniform mutual spacing from one another for clamping-in sheet stacks.

According to the prior art, roller chains having links which engage individually movably into one another are preferably used as conveying devices. The chains serve to advance the clamps. However, the clamps are guided by guide tracks which are connected fixedly to the machine frame of the book binding machine. To that end, each clamp has a plurality of running rollers which roll on a running face of the guide track.

It is disadvantageous in book binding machines of that type that the chains and the chain guides are subjected to very high wear. That requires a stable construction, that is to say high moved masses. The drive of the clamps by the chain brings about a non-uniform movement profile of the chain and the introduction of vibrations due to the so-called polygonal effect. If the chain and therefore the clamps and book blocks are stopped in an emergency stop, that takes place in the manner of a jolt. Furthermore, it is disadvantageous that it is not possible to remove faulty book blocks. It is likewise disadvantageous that the speeds of the workstations have to be adapted to the speed of the chain with the clamps. Speeds which are ideal for the respective processing process cannot therefore be chosen. In other words, the speeds of the workstations cannot be optimized individually, but rather are dependent on the chain speed. That in turn determines the performance of the adhesive or perfect binder.

SUMMARY OF THE INVENTION

It is accordingly an object of the invention to provide a book binding machine, which overcomes the hereinaforementioned disadvantages of the heretofore-known devices of this general type.

With the foregoing and other objects in view there is provided, in accordance with the invention, a book binding machine for producing printed products, such as books, magazines or brochures. The book binding machine includes individually driven processing stations such as a book block insertion station, a book spine processing station, a glue application station, a cover feeder and a pressing station. A transport system interconnects the processing stations and has a multiplicity of clamps for clamping-in book blocks, sheet stacks, collated signatures or the like. A guide track is provided along which the clamps are guided and individually driven.

In accordance with another feature of the invention, the clamps are advantageously driven by linear motors or servomotors.

In accordance with a further feature of the invention, the transport system of the book binding machine has a control unit for controlling the speeds of the respective clamps. Each clamp can therefore be moved on the guide track at a dedicated speed.

In accordance with an added feature of the invention, the speeds of the clamps are controlled as a function of different parameters, including the position of the clamp within the book binding machine. The clamp can thus move more slowly in processing stations and more quickly in pure transport paths. Furthermore, the speed can be controlled as a function of the product thickness. The speed can thus be reduced in the book spine processing station for the exact processing of thick books. A further parameter can be the viscosity of the adhesive which is processed in the glue application station. Seen more generally, each processing station and the associated processing tools have an optimum processing speed. As a rule, processing stations have to be operated synchronously with the processed book blocks. The advantageous control according to the invention of the speeds of the respective clamps and the actuation of the speed of a processing tool of a respective processing station result in the possibility of increasing the synchronous running windows of the tool and the book block. As a result, a greater time window is available for the processing and the processing can take place more exactly.

In accordance with an additional feature of the invention, the control unit permits the individual stopping of the clamps. If there is faulty processing at a defined position within the book binding machine, the clamp can be stopped immediately with the respective book block. The clamps which have already passed through the processing station are transported further through the following processing stations of the book binding machine, with the result that their book blocks can be finished without being spoiled. Following clamps which have not yet passed through the processing station are likewise stopped. If, however, those clamps include clamps which are situated in a processing station at the moment of stopping, the processing of the respective book blocks in the processing stations is concluded, if possible, and the respective clamps are subsequently stopped. The possibility of stopping and actuating the clamps individually therefore reduces the spoilage substantially.

In accordance with yet another feature of the invention, the guide track of the transport system has at least one diverter for removing clamps and at least one other diverter for inserting clamps, with two guide track sections which are situated between them. One or more processing stations, for example a severing saw for the production of multiple copies, can be situated in the region of at least one of the guide track sections. As an alternative or in addition, a device for removing spoiled book blocks can be situated in the region of at least one guide track section.

In accordance with a concomitant feature of the invention, the book binding machine has a machine controller for controlling the synchronous running of a respective clamp of the transport system in the region of a processing station, and for controlling the synchronous running of the corresponding processing station and its tool. The controller therefore intervenes both in the individual drives of the processing stations and in the control unit of the transport system.

Other features which are considered as characteristic for the invention are set forth in the appended claims.

Although the invention is illustrated and described herein as embodied in a book binding machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
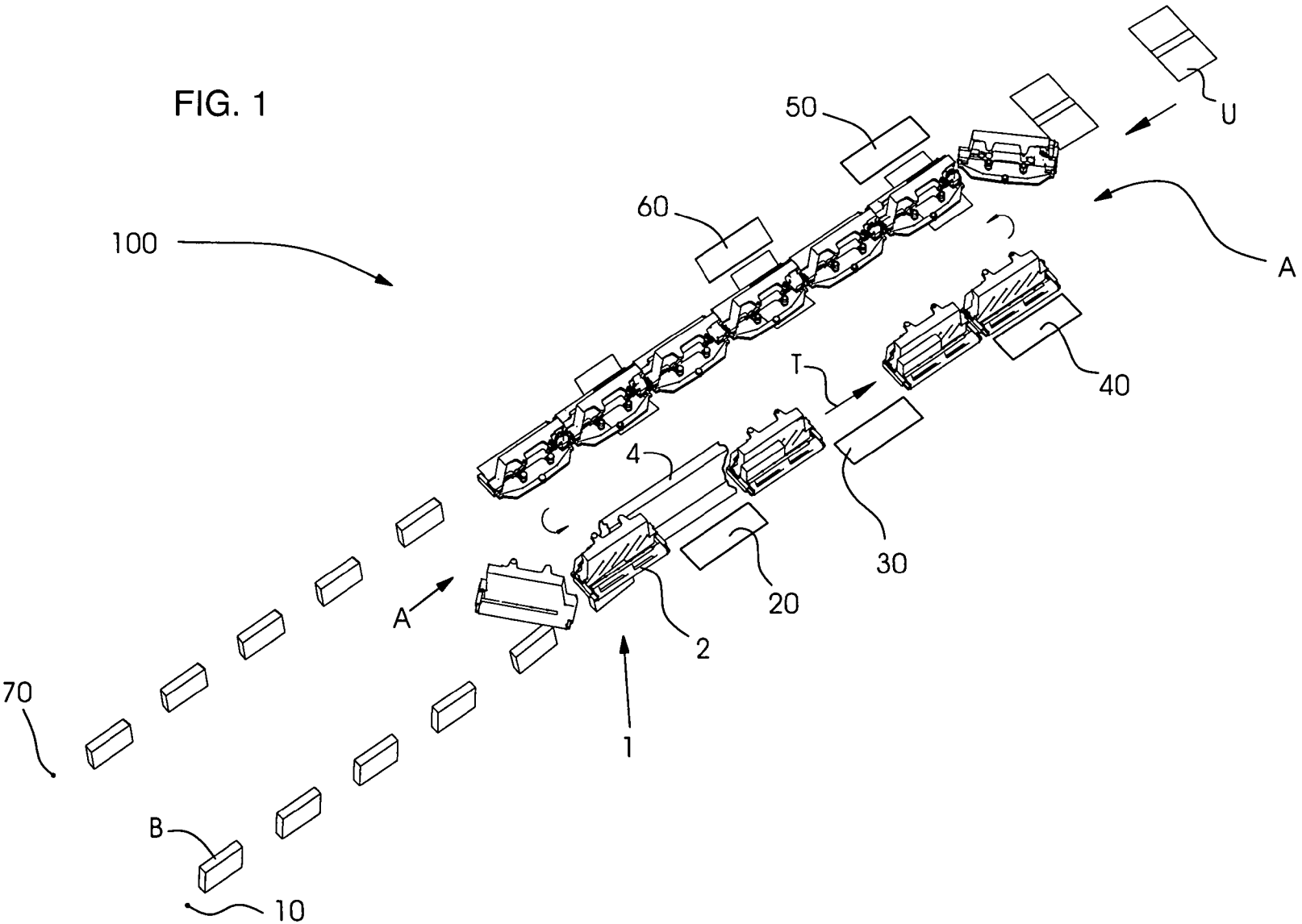
FIG. 1 is a fragmentary, diagrammatic, perspective view of an adhesive or perfect binder with an illustration of book blocks and clamps.

Referring now to the figures of the drawings in detail and first, particularly, to FIG. 1 thereof, there is seen a portion of a book binding machine in the form of an adhesive or perfect binder 100 with part of an associated book block transport system 1. Book blocks B, coming from a collating machine 10, are fed in a transport direction T to the adhesive or perfect binder 100. The book blocks B are gripped by clamps 2 and transported to a first processing station, which is a spine processing station 20. The spine processing station 20 can have a plurality of non-illustrated processing tools. A book block B, which has its spine processed, is transported further to a glue application station 30 and is provided with adhesive. A slip fold can be applied in a following slip-fold station 40. Covers U are placed onto the book blocks B by a cover feeder 50, pressed in a pressing station 60 and connected to one another. Subsequently, the book blocks are transported further by a separate transport system through a cooling section and to triple side trimming 70. As can be seen from FIG. 1, the spacing of the clamps 2 from one another is not constant. This results from the fact that the clamps 2 are transported at different speeds along a guide track 4 of the book block transport system 1. The clamps can thus be moved more slowly in the region of the processing stations 20, 30, 40, 50, 60 and more quickly in the region of pure transport paths, for example deflection regions A. As a result, the processing stations 20, 30, 40, 50, 60 can be operated at an ideal speed, and high productivity of the adhesive or perfect binder 100 can also be achieved.

Figure 2:
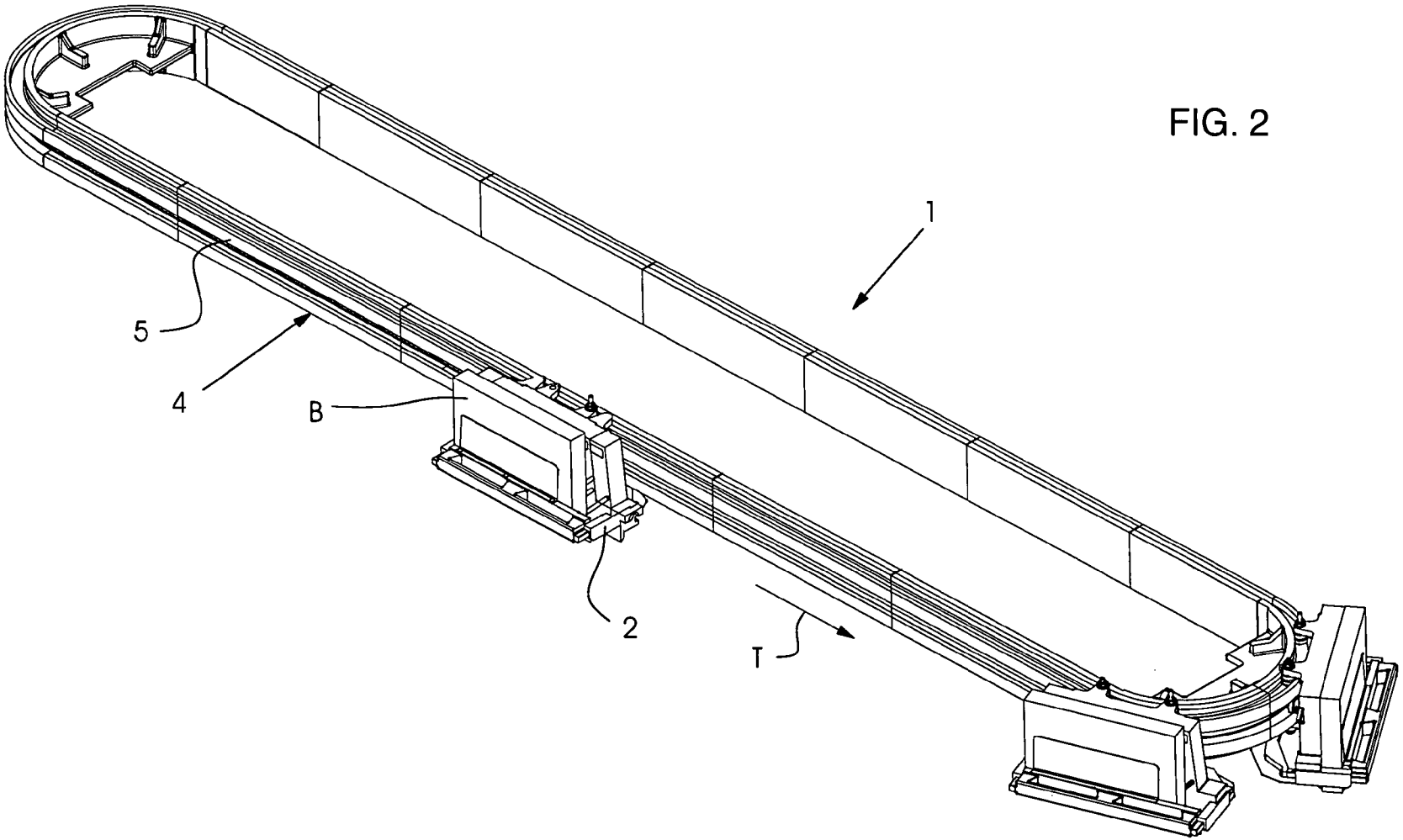
FIG. 2 is a perspective view of a segmented guide track of a book block transport system.

FIG. 2 illustrates the book block transport system 1 in greater detail, showing that it includes the clamps 2 which are guided on the guide track 4. The clamps 2 are driven by linear motors. The guide track 4 includes a multiplicity of segments 5 which are only diagrammatically shown herein. It goes without saying that the segmentation has to be of substantially finer configuration. The clamps 2 are moved in the transport direction T by a traveling wave or traveling field which is generated in the segments 5 of the guide track 4. Devices for generating the traveling wave or traveling field are provided at the discretion of a person skilled in the art and are not shown in FIG. 2.

Figure 3:
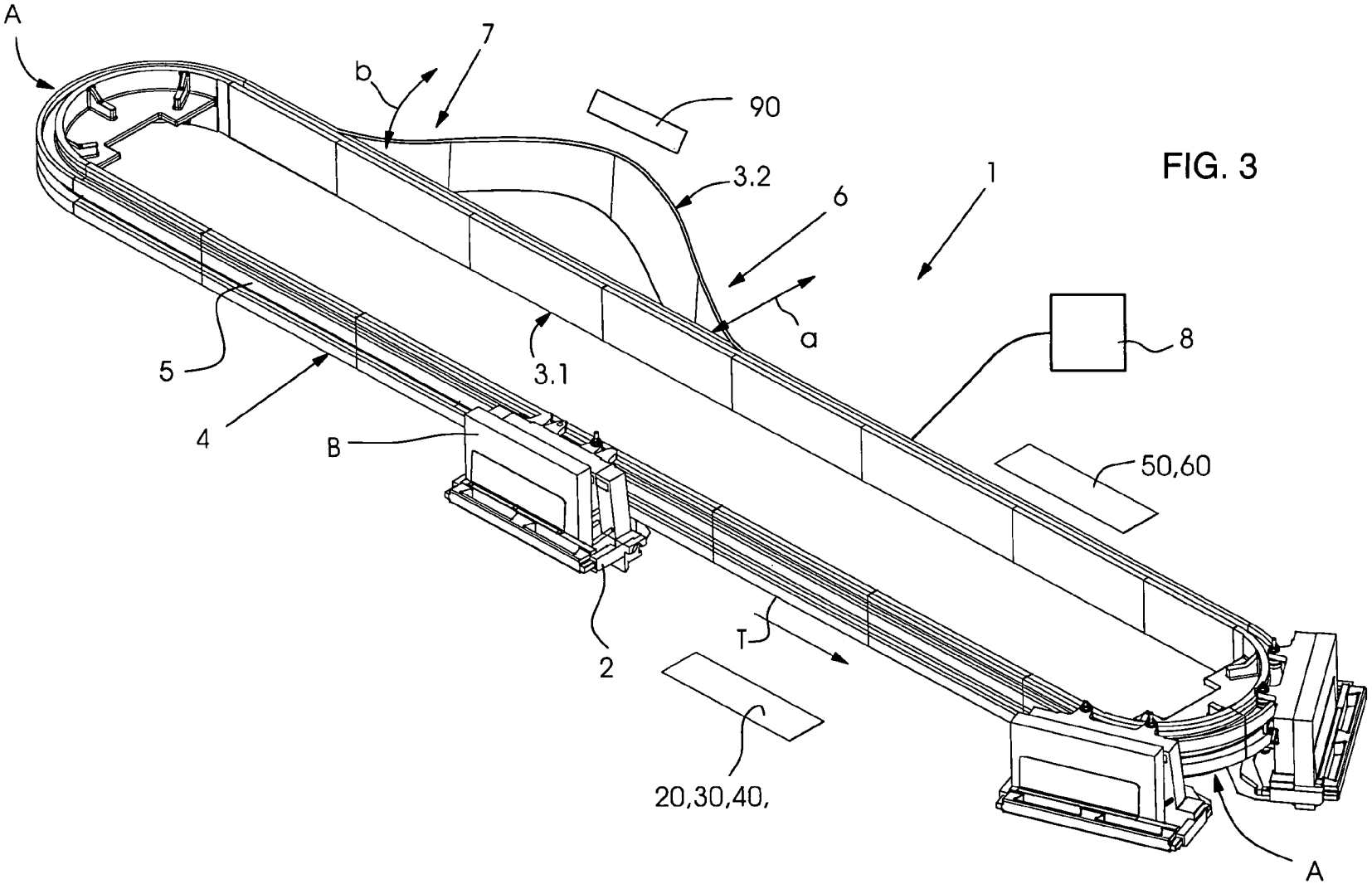
FIG. 3 is a perspective view of a variant of the guide track of FIG. 2 with two diverters.

FIG. 3 likewise shows a book block transport system 1 with clamps 2 which are guided on a guide track 4. The traveling wave or traveling field, which is applied in the segments 5 of the guide track 4, is controlled by a control unit 8 of the transport system 1. It is possible, by corresponding control of the traveling wave or traveling field, for the clamps 2 to pass through the processing stations 20, 30, 40, 50, 60, 90 slowly and through the pure transport paths, such as the curved paths A, quickly. Furthermore, the book block transport system 1 has a first diverter 6 which is followed by a first guide track section 3.1 and a second guide track section 3.2. The two guide track sections 3.1 and 3.2, which run in parallel, are brought together again by a second diverter 7. An optional processing station 90 is situated in the region of the second guide track section 3.2. A clamp 2, which comes from the processing stations 50, 60, can be guided into the guide track section 3.2 and therefore through the optional processing station 90 by a switching a of the first diverter 6 and guided from the guide track section 3.2 by a switching b of the second diverter 7.

The invention claimed is:

1. A book binding machine for producing printed products, the book binding machine comprising:

individually driven processing stations each having processing tools with an optimal individually controlled processing speed;

a transport system interconnecting said processing stations, said transport system having a multiplicity of clamps for clamping book blocks, said clamps being driven at a varying individually controlled optimized speed and said processing tools being actuated for increasing a length of a synchronous window between the book blocks and said processing tools of each of said processing stations depending on said optimal processing speed; and a guide track along which said clamps are guided and individually driven.

2. The book binding machine according to claim 1, which further comprises linear motors for driving said clamps.

3. The book binding machine according to claim 1, wherein said transport system has a control unit for controlling respective speeds of said clamps and actuation of said processing tools for increasing said length of said synchronous window.

4. The book binding machine according to claim 3, wherein the speeds of said clamps are controlled as a function of different parameters, including a position of said clamps within the book binding machine.

5. The book binding machine according to claim 1, wherein said control unit is configured for individually stopping said clamps.

6. The book binding machine according to claim 1, wherein said guide track of said transport system has two guide track sections, at least one first diverter for removing said clamps and at least one second diverter for inserting said clamps, said two guide track sections being disposed between said first and second diverters.

7. The book binding machine according to claim 6, which further comprises a processing station disposed in vicinity of at least one of said two guide track sections.

8. The book binding machine according to claim 6, wherein spoiled book blocks can be removed in vicinity of at least one of said two guide track sections.

9. The book binding machine according to claim 1, which further comprises a machine controller for controlling synchronous running of a respective processing station and of one of said clamps of said transport system situated in vicinity of said respective processing station.

10. A book binding machine for producing books, magazines or brochures, the book binding machine comprising:

individually driven processing stations selected from the group consisting of a book block insertion station, a book spine processing station, a glue application station, a cover feeder and a pressing station, said processing stations each having processing tools with an optimal individually controlled processing speed;

a transport system interconnecting said processing stations, said transport system having a multiplicity of clamps for clamping book blocks, said clamps being driven at a varying individually controlled optimized speed and said processing tools being actuated for increasing a length of a synchronous window between the book blocks and said processing tools of each of said processing stations depending on said optimal processing speed;

motors for driving said clamps; and a guide track along which said clamps are guided and individually driven.

11. The book binding machine according to claim 1, which further comprises servomotors for driving said clamps.

12. The book binding machine according to claim 10, wherein said motors are linear motors.

13. The book binding machine according to claim 10, wherein said motors are servomotors.

* * * * *